United States Patent [19]

Gilb

[11] 4,413,456

[45] Nov. 8, 1983

[54] MUD-SILL ANCHOR

[75] Inventor: Tyrell T. Gilb, Berkeley, Calif.

[73] Assignee: Simpson Strong-Tie Company, Inc., San Leandro, Calif.

[21] Appl. No.: 362,026

[22] Filed: Mar. 25, 1982

[51] Int. Cl.[3] ..... E02D 27/00

[52] U.S. Cl. ..... 52/295; 52/714

[58] Field of Search ..... 52/714, 715, 712, 295, 52/370

[56] References Cited

U.S. PATENT DOCUMENTS

| | | | |
|---|---|---|---|
| 1,767,575 | 6/1930 | Bujack | 52/370 |
| 2,431,104 | 11/1947 | Bright | 52/715 X |
| 3,750,360 | 8/1973 | Kingston . | |
| 3,889,441 | 6/1975 | Fortine . | |
| 4,005,942 | 2/1977 | Gilb | 403/189 |

FOREIGN PATENT DOCUMENTS

| | | | |
|---|---|---|---|
| 103929 | 5/1938 | Australia | 52/370 |

OTHER PUBLICATIONS

*Silver Metal Products Inc.*, sales brochure, FA, p. 13, Apr. 1972.

*Primary Examiner*—Carl D. Friedman

*Attorney, Agent, or Firm*—James R. Cypher

[57] ABSTRACT

A singleside sheetmetal mudsill anchor for anchoring a sill plate to a concrete foundation having an embedded leg and a pair of laterally spaced arms connected to the upper end of the leg extending in a vertical plane parallel to each other and to the embedded leg. The arms are adapted for bending around the sill member and have fastener openings for connecting the anchor to the sill member.

7 Claims, 7 Drawing Figures

MUD-SILL ANCHOR

BACKGROUND OF THE INVENTION

There are several different accepted ways to attach a wood sill plate to the top of a foundation wall or slab. The oldest way is to insert threaded anchor bolts into the concrete as soon as the pour is completed and leveled off. Holes are drilled in the sill plate and the plate is then set on the foundation with the anchor bolts protruding through the openings.

Several manufacturers are offering sheet metal connectors which replace the threaded bolts. Examples of such sheet metal anchors are found in U.S. Pat. Nos. 3,889,441 and 3,750,360. Both of these patents have arms which protrude on either side of the sill plate and if a concrete slab is to be poured, the upstanding arms interfere with mechanical equipment for screeding and trowling the slab.

An alternate mud-sill anchor is disclosed in my copending application, Ser. No. 06/215,730 filed Dec. 12, 1980.

SUMMARY OF THE INVENTION

The anchor of the present invention totally supplants the use of anchor bolts at less than half of the installed cost of one-half inch anchor bolts.

The parallel top-attachment arms provide spacing which meets the requirements of the international conference of building officials (uniform building code) for six (6) nail attachment to the mud sill.

The heavily bossed and footed embeddment element provides full withdrawal resistance in any direction.

The mud sill anchor can be placed either prior to or immediately after the pouring of the concrete.

The unique manner in which the anchor is attached to the form provides for flat nailing attachment without requiring the nail to be removed prior to removing the form.

The anchor permits full finishing machine operation without interference from upright elements or double-nail heads.

A pair of tab members provides placement stability when the anchor is attached to the foundation form.

After installation, the anchor has no upstanding elements and therefore a frame wall does not have to be lifted over any upstanding anchor members.

The dual arm design provides maximum attachment flexibility to mud sills of many thicknesses and widths. Further, the arm design permits placement irrespective of stud location.

The anchor is embedded in the concrete so that there is no exposed metal after the forms are stripped.

DESCRIPTION OF THE PREFERRED EMBODIMENTS

Figure 1:
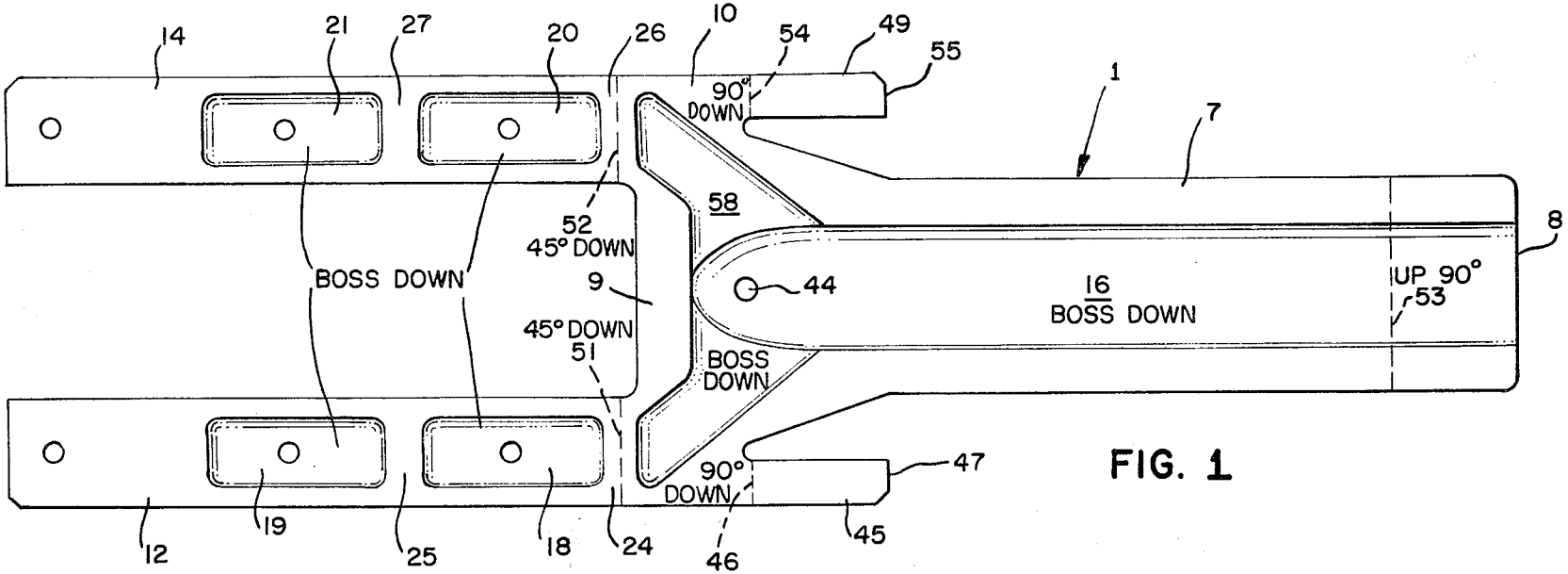
FIG. 1 is a top plan view of the sheet metal blank from which the mud sill anchor of the present invention is constructed.
Figure 3:
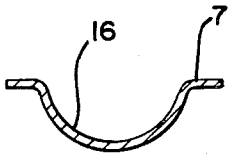
FIG. 3 is a cross sectional view of a portion of the anchor taken along line 3—3 of FIG. 2.
Figure 2:
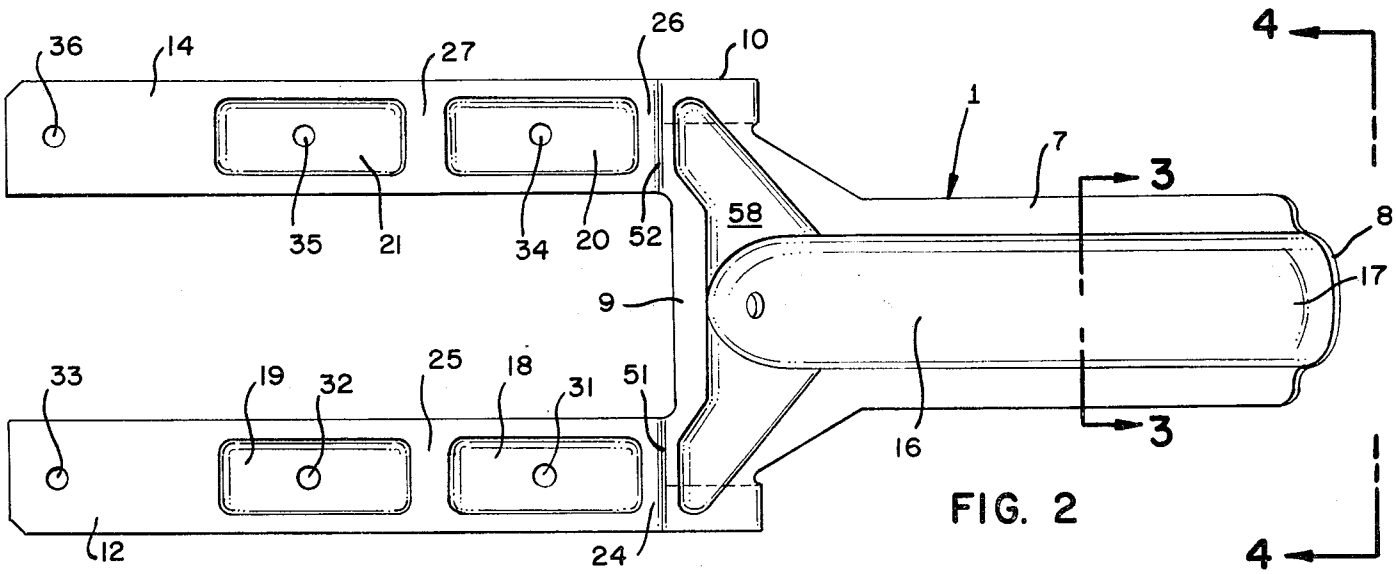
FIG. 2 is a top plan view of the anchor of the present invention as constructed from the blank of FIG. 1.

The single side sheet metal mudsill anchor 1 of the present invention is used for anchoring a sill plate 2 to a concrete foundation 3. The anchor is temporarily attached to a form member 4 by means such as a nail 6. The anchor is formed from a single piece of sheet metal as illustrated in FIG. 1. The anchor consists briefly of an embedded leg 7 having a distal end 8.

The leg is positioned downwardly at an angle within the foundation and away from the form member 4. An upper end 9 is formed with a T-shaped member 10 for receiving a first mudsill attachment arm 12 integrally connected to the upper end of the T-shaped member and extends above and outwardly from the form board wherein the plane of the arm is generally parallel to the top surface 13 of the foundation.

A second mudsill attachment arm 14 integrally connected to the other side of the T-shaped member extends above and outwardly from the form board in generally the same plane as the first arm and generally parallel thereto.

Anchor leg 7 is formed with an embossment 16 which extends substantially the length of the leg.

Preferably, the distal end of the leg is formed with an angularly upturned portion 17 which increases the mechanical engagement with the foundation.

Arms 12 and 14 are formed with longitudinally aligned embossed portions 18, 19, 20 and 21 and are pre-bent along bend lines 51 and 52 to a 45 degree angle.

The arms 12 and 14 each have a length selected for extending up the side edge 22 and over a substantial portion of the upper side 23 of the sill. The embossed portions 18–21 are interrupted at each of two selected bend points 24–27 which occur at the edges 28 and 29 of the sill 2.

Arms 12 and 14 are formed with fastener openings 31–36 for driving fasteners 37–42 therethrough and into the sill 2.

A restricted opening 44 is formed in the upper end of leg 7 for receiving fastener 6 positioned for engaging the form member 4 and permitting the removal of the form member without withdrawing the fastener from the form.

Positioning tabs 45 and 49 may be formed from leg 7 and bent along bend lines 46 and 54 so that it extends rearwardly and engages the face 11 of the foundation form member 4. When the ends 47 and 55 of tabs 45 and 49 engage the face of the foundation, they cooperate with the arms 12 and 14 resting on top edge 56 of the form in positioning the anchor at a preselected angle 48 with respect to the form member 4.

As an example, referring to FIG. 1, the anchor 1 may be formed from a 16 gauge galvanized steel blank 3"×10½". The leg member to be embedded in concrete is approximately 6¼" long, with ⅞" boss×5/16" draw depth, terminating in a 1⅛" bossed hook element bent to 90 degrees along bend line 53. Two 15/16"×5/16" tapered positioning tabs are provided, at 90 degrees, for form standoff positioning purposes when the unit is installed at the required 45 degree angle. Installed, the vertical embedded depth is four (4) inches. The two (2) legs are 4¼" long, each having two bosses and three holes sized for N10 nails.

Installation assumes concrete having a minimum compressive strength of 2,000 pounds per square inch at 28 days, with spacing and other location control in accordance with Section 2907(e) of the code, where used to replace foundation bolts. The legs are so configured as to provide code-spaced nailing for six (6) 10d or N10 (1½" long) nails when attached to mudsills of nominal 2×4, 3×4, 2×6, 3×6 or like dimensions, including special conditions when one of the legs is disposed upwards at a stud location.

Installation is permitted wherever not less than four (4) inches of concrete depth is provided. If such depth is over a horizontal cold joint such as to a concrete foundation wall, or foundation wall formed of concrete block, then separate means must be provided as required for connecting the elements adjacent to the horizontal cold joint.

Figure 5:
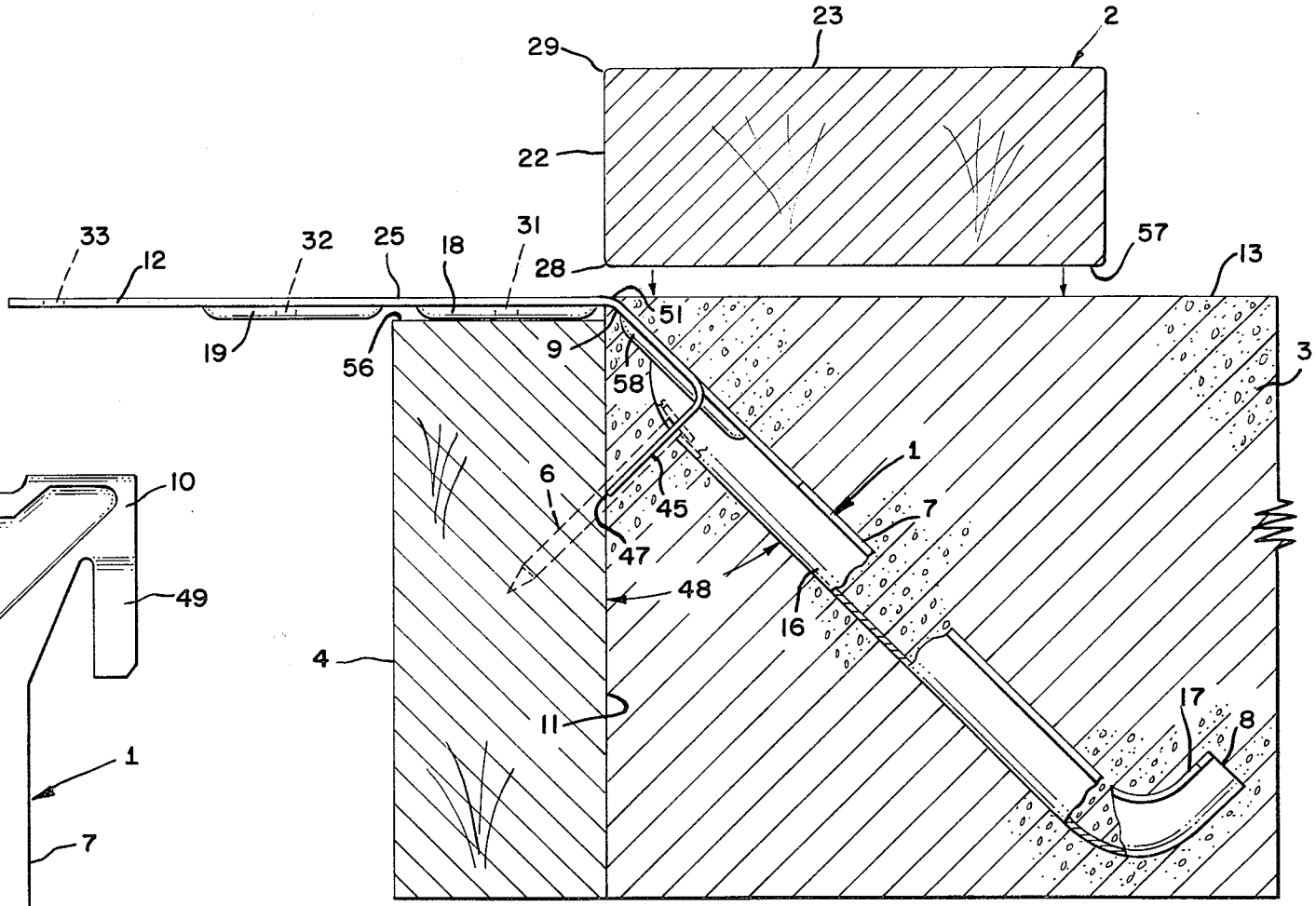
FIG. 5 is a side elevation view of the anchor with portions in cross section. The anchor is shown embedded in a concrete foundation and attached to a form board. The sill member is illustrated to show its location after the form board has been removed.
Figure 4:
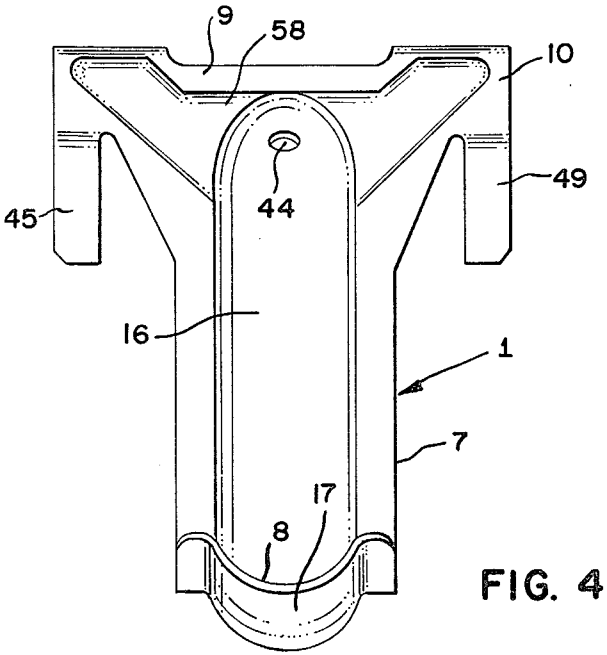
FIG. 4 is a front elevation view of the anchor shown in FIG. 2 taken in the direction of arrows 4—4 of FIG. 2.
Figure 7:
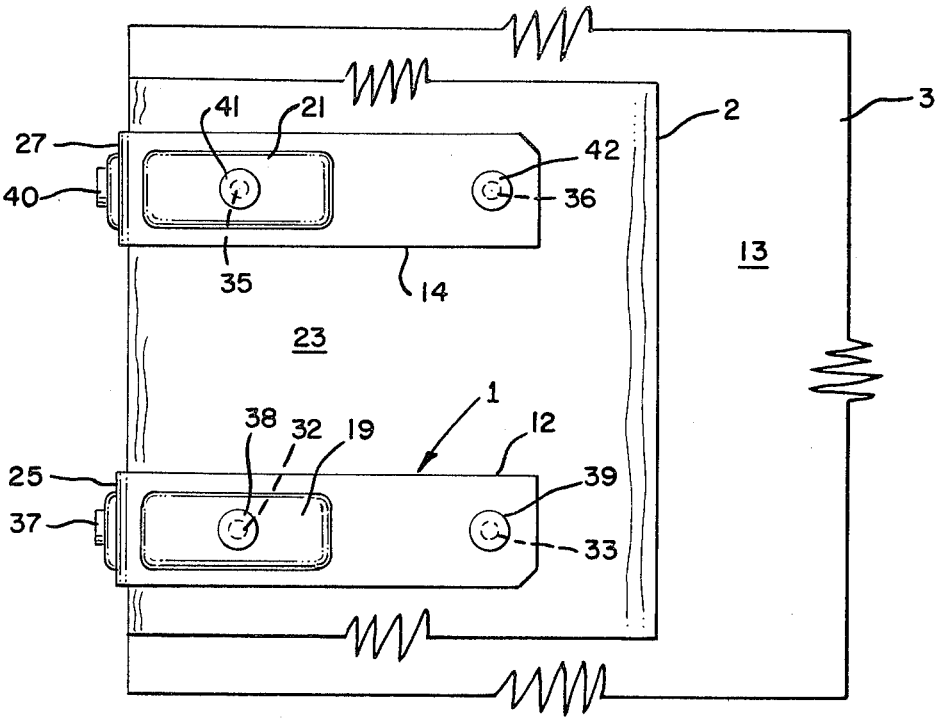
FIG. 7 is a top view of the anchor member attached to a sill member as shown in FIG. 6.
Figure 6:
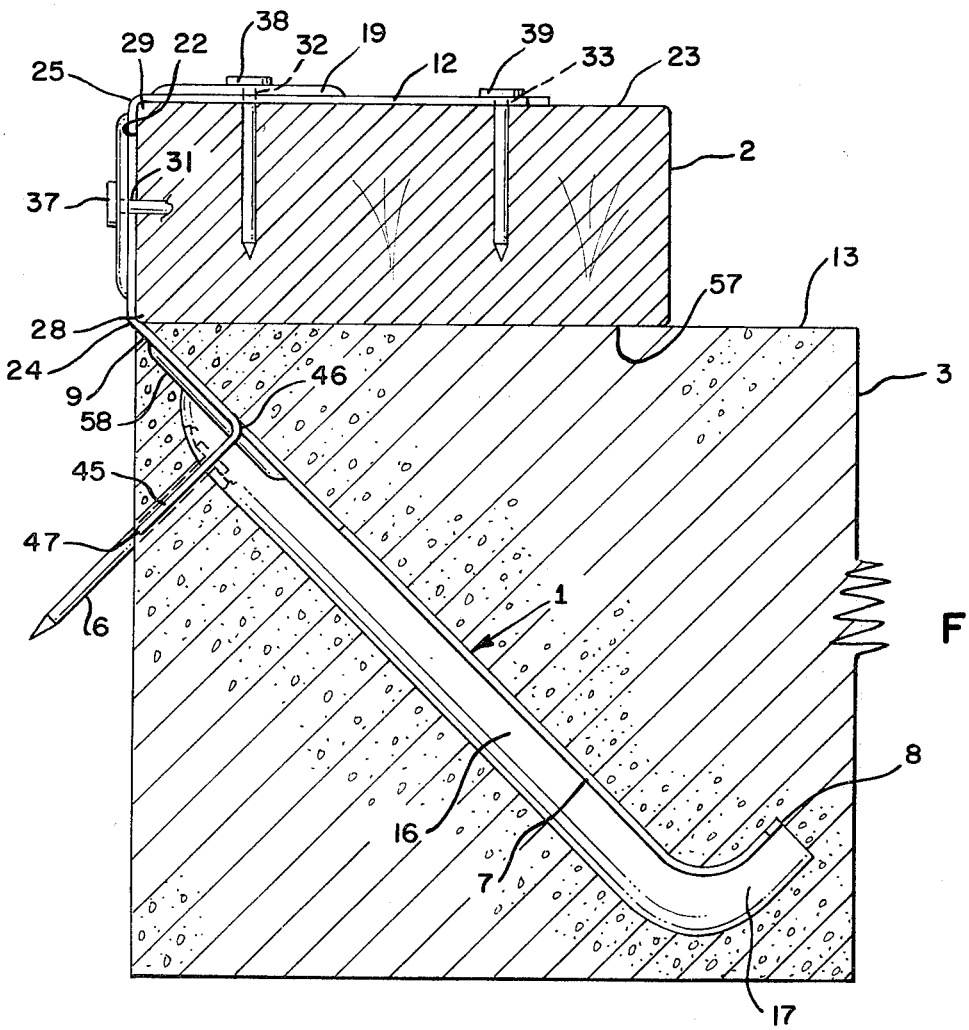
FIG. 6 is a side view of the anchor connected to the sill member. The concrete foundation is shown in cross section.

Referring to FIGS. 5, 6 and 7, the anchor 1 is preferably installed prior to pouring the concrete slab. The anchor is placed as shown in FIG. 5. Nail 6 is driven through opening 44 into form board 4.

After the concrete is poured and sets, the form board 4 may be stripped from the slab without removing nail 6 Note, no nails are driven through the nail openings in the arms into the form boards.

The bottom side 57 of mudsill 2 is placed on top of the concrete 13 and arms 12 and 14 are bent upwardly 90 degrees in areas 24 and 26, along side edge 22 of the sill member. The arms are then bent again in areas 25 and 27 so that the arms are in contact with the upper face 23 of the sill member. Nails 37–42 are then driven into the sill member.

The anchor has been ICBO tested and has been formally approved for the following values:

| MUDSILL SIZES | NAILING SCHEDULE |
|---|---|
| 2 × 4, 3 × 4 | 6-10 d or |
| 2 × 6, 3 × 6 | 6-N10 (× 1½") |

ALLOWABLE LOAD (in pounds) 1.2

| UP-LIFT | PARALLEL TO MUDSILL | PERPENDICULAR TO PLATE AND INTO ANCHOR | PERPENDICULAR TO PLATE AND AWAY FROM ANCHOR |
|---|---|---|---|
| 990 | 720 | 940 | 940 |

1. Loads are for Douglas fir-larch or Southern pine. For other species adjust on the basis of relative group classification in accordance with U.B.C. Standard No. 25-17.
2. The loads are not subject to increase for duration of load.

The mudsill anchor is designed so that there is a minimum waste in cutting and so that cutting and forming may be accomplished by progressive die techniques. For example, the leg 7 has an unformed width of 1½ and this is the dimension between legs 12 and 14. Preferably the T-shaped member 10 is embossed in portions 58 to strengthen the upper end 9 of the leg member.

I claim:

1. A singleside sheetmetal mudsill anchor for anchoring a sill plate to a concrete slab foundation comprising:

a. a concrete slab foundation having a generally horizontal top surface and a perimeter;

b. a nailable form board member having an inner face temporarily placed in contact with a portion of said perimeter and an upper edge positioned parallel to said top surface of said concrete slab foundation;

c. a wood mudsill having a top face and an edge positioned on said concrete slab perimeter when said concrete hardens;

d. said anchor is formed from a single piece of sheetmetal and includes an embedded leg having a distal end embedded at an angle to said top surface of said slab and positioned downwardly within said slab foundation and inwardly from said slab perimeter and having an upper end positioned adjacent the intersection of said inner face and upper edge of said form board;

e. said anchor includes first and second laterally spaced and parallel mudsill attachment arms integrally connected to said upper end of said leg and each having a portion dimensioned for temporarily resting upon said upper edge of said form board and extending outwardly from said form board and said slab perimeter wherein the planes of said arms are temporarily on generally the same plane and generally parallel to said top surface of said slab foundation;

f. said first and second arms are laterally spaced a distance equal to the initial width of said anchor leg and have a length selected to span said mudsill edge and a substantial portion of said mudsill top face when bent over said mudsill member from the same side of said mudsill; and g. fastener means connecting said first and second arms to said top face of said mudsill member.

2. An anchor as described in claim 1 wherein:

a. said leg is formed with an embossment extending substantially the length of said leg; and b. leg means formed in said leg member adapted for providing temporary attachment to said form member.

3. An anchor as described in claim 1 wherein:

a. said distal end of said leg is formed with an angularly upturned portion adapted for increased mechanical engagement with said foundation; and b. said leg means consist of an opening therethrough adapted for receiving a nail adapted to be driven into said form member.

4. An anchor as described in claim 1 wherein:

a. said arms are formed with a plurality of longitudinally aligned embossed portions.

5. An anchor as described in claim 4 wherein:

a. said arms each have a length adapted for extending up the side edge and over a substantial portion of the upper side of said sill;, and b. said embossed portions of each of said arms are interrupted at each of two selected bend points which occur at the edges of said sill.

6. An anchor as described in claim 5 wherein:

a. said arms are formed with fastener openings adapted for driving fasteners therethrough and into said sill.

7. An anchor as described in claim 1 comprising:

a. a positioning tab formed from said upper end of said leg and extending at an angle thereto and positioned for engaging said inner face of said foundation form member for automatically positioning said anchor leg at a preselected angle with respect to said top surface of said slab foundation.

* * * * *